US005833039A

United States Patent [19]

Kotkins, Jr.

[11] Patent Number: 5,833,039

[45] Date of Patent: Nov. 10, 1998

[54] SOFT LUGGAGE HANDLE ASSEMBLY FOR WHEELED CASE

[75] Inventor: Henry L. Kotkins, Jr., Seattle, Wash.

[73] Assignee: Skyway Luggage Company, Seattle, Wash.

[21] Appl. No.: 583,564

[22] Filed: Jan. 5, 1996

[51] Int. Cl.[6] ..... A45C 5/14; A45C 13/22; A45C 13/26

[52] U.S. Cl. ..... 190/115; 190/18 A; 190/39; 16/115

[58] Field of Search ..... 190/18 A, 115, 190/39; 16/115

[56] References Cited

U.S. PATENT DOCUMENTS

| | | | |
|---|---|---|---|
| 1,028,178 | 6/1912 | Batchelor . | |
| 2,463,713 | 3/1949 | Partiot | 280/37 |
| 2,564,939 | 8/1951 | Weast | 280/36 |
| 2,925,283 | 2/1960 | Stilger | 280/37 |
| 3,522,955 | 8/1970 | Warner, Jr. | 280/47.37 |
| 3,842,953 | 10/1974 | Royet | 190/18 A |
| 3,946,839 | 3/1976 | Butler | 190/18 A |
| 4,036,336 | 7/1977 | Burtley | 190/18 A |
| 4,228,877 | 10/1980 | Cothary | 190/18 A |
| 4,254,850 | 3/1981 | Knowles | 190/18 A |
| 4,261,447 | 4/1981 | Arias et al. | 190/18 A |
| 4,314,624 | 2/1982 | Royet | 190/18 A |
| 4,340,132 | 7/1982 | Cerna | 190/18 A |
| 4,995,487 | 2/1991 | Plath | 190/18 A |
| 5,048,649 | 9/1991 | Carpenter et al. | 190/18 A |
| 5,115,895 | 5/1992 | Myers | 190/18 A |
| 5,116,289 | 5/1992 | Pond et al. | 190/18 A |
| 5,167,306 | 12/1992 | Carrigan | 190/18 A |
| 5,197,579 | 3/1993 | Bieber et al. | 190/18 A |
| 5,240,106 | 8/1993 | Plath | 206/316.2 |
| 5,335,759 | 8/1994 | Yeh | 190/115 |
| 5,368,143 | 11/1994 | Pond et al. | 190/18 A |
| 5,393,079 | 2/1995 | Wang | 280/37 |
| 5,431,263 | 7/1995 | Nordstrom | 190/18 A |
| 5,433,303 | 7/1995 | Chen | 190/24 X |
| 5,456,342 | 10/1995 | Rekuc et al. | 190/115 X |
| 5,482,147 | 1/1996 | Wang | 190/18 A X |
| 5,524,737 | 6/1996 | Wang | 16/115 X |
| 5,542,510 | 8/1996 | Rekuc et al. | 190/18 A |
| 5,588,513 | 12/1996 | Lin | 190/18 A X |
| 5,590,748 | 1/1997 | Chang | 190/18 A |

FOREIGN PATENT DOCUMENTS

| | | |
|---|---|---|
| 2 168 035 | 6/1986 | United Kingdom . |
| 2280844 | 2/1995 | United Kingdom . |

*Primary Examiner*—Sue A. Weaver
*Attorney, Agent, or Firm*—Seed and Berry LLP

[57] ABSTRACT

A soft-sided roller supported luggage or case with telescopic handle rods is provided with housings that secure to at least two of the top wall, end wall, or rear wall of the case. In one embodiment the housings are secured to all three of the top, rear, and end walls. The housings extend less than the full length of the case leaving considerable extra storage space within the case and, for external housings, reducing the chance of bending or other damage to the housings. The rigid connection between the housings and at least at two walls and preferably three walls provides sufficient support for holding the weight of the case with the handle rods extended. The housings on an internal case are preferably located at or close to the corners of the rear and end walls of the case to again increase the unobstructed storage space in the case.

22 Claims, 4 Drawing Sheets

Fig. 4
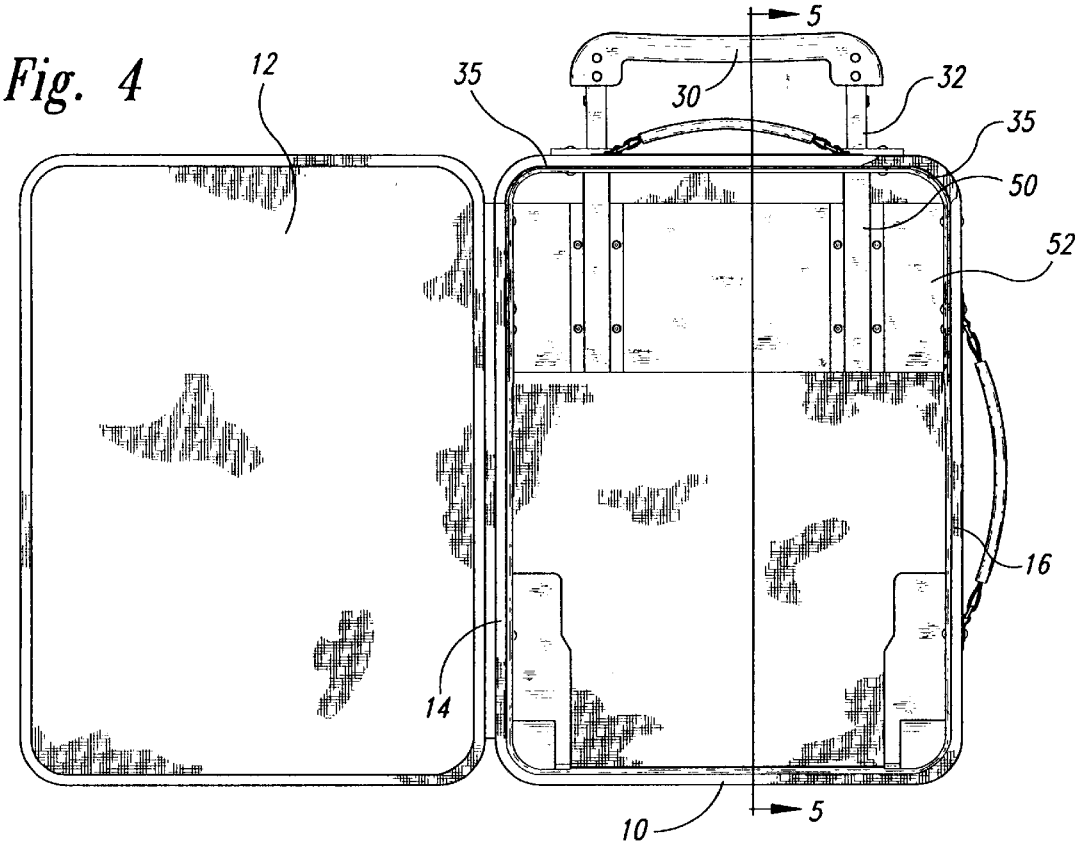
Fig. 5
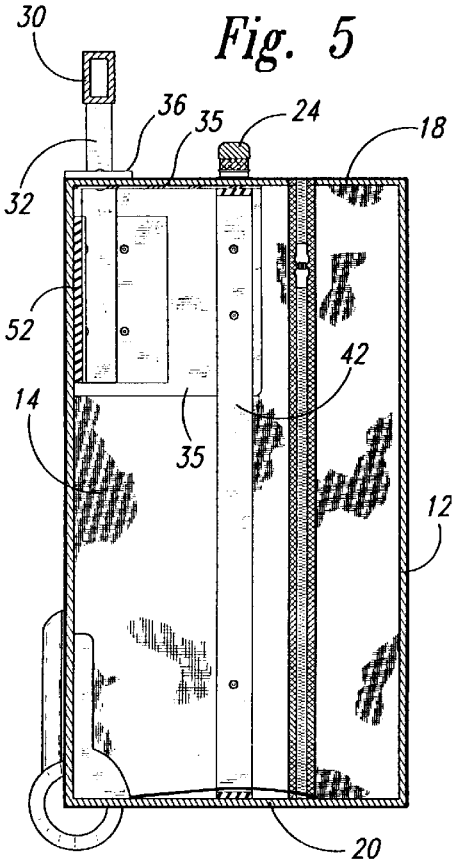
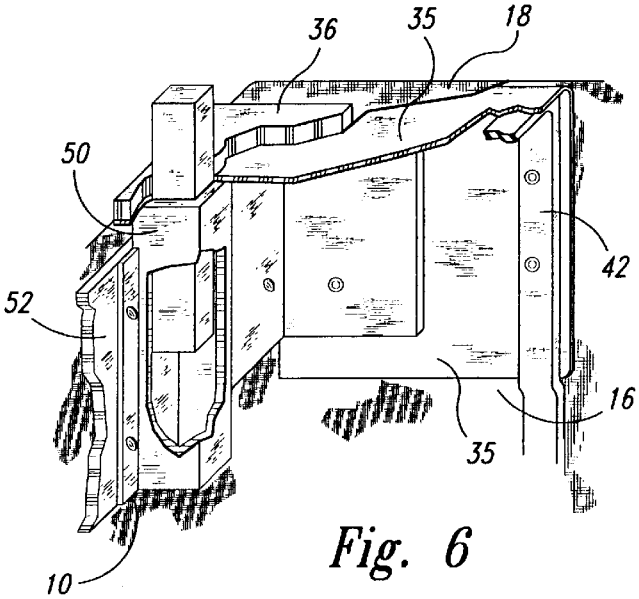
Fig. 6

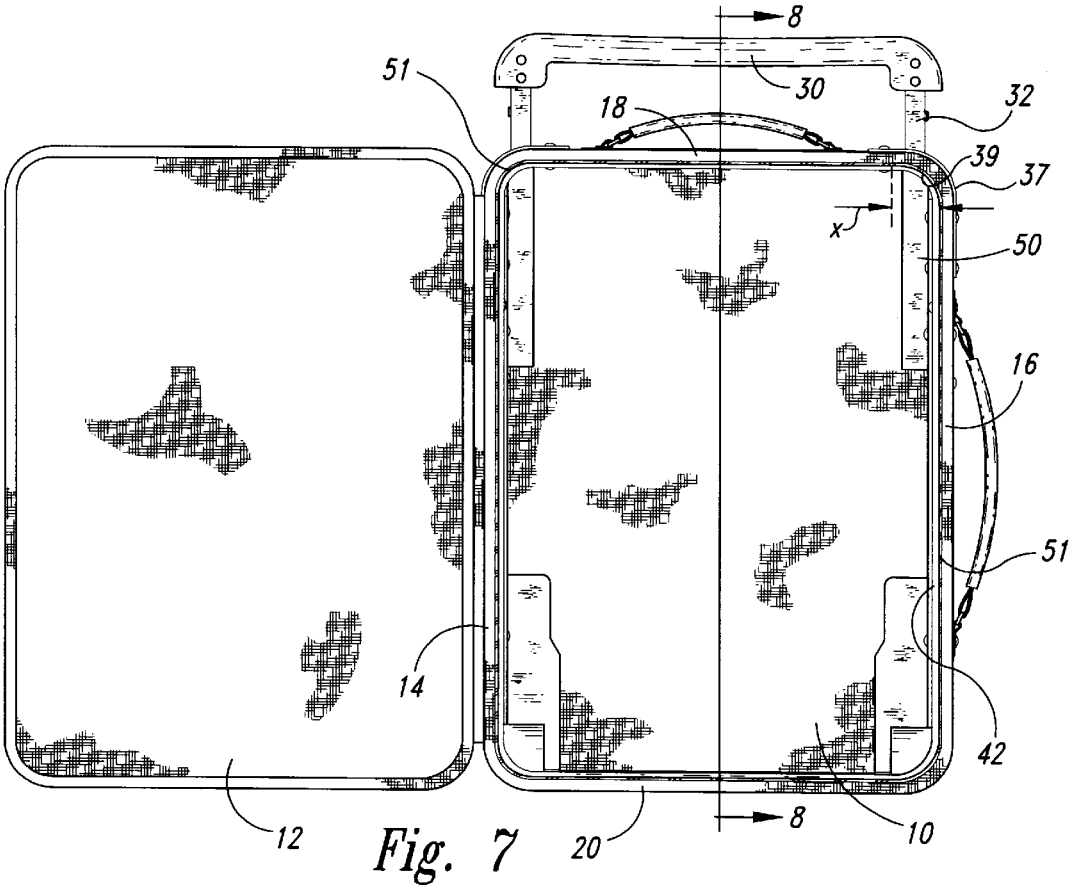
Fig. 7
Fig. 8
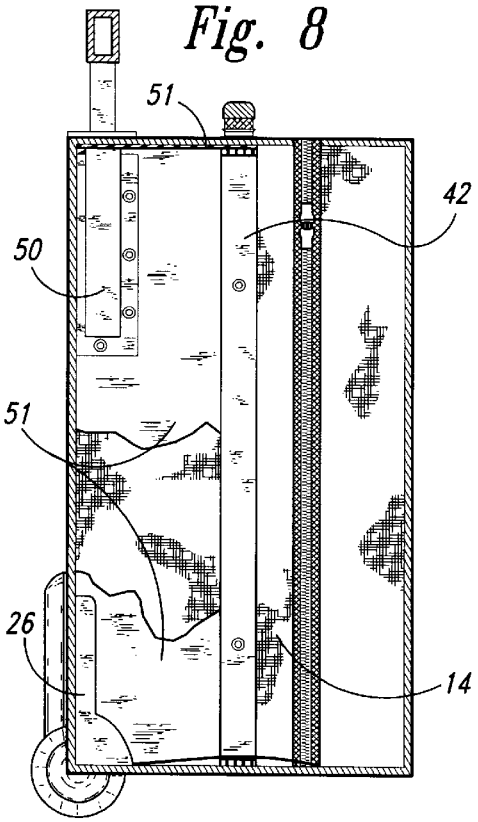
Fig. 9
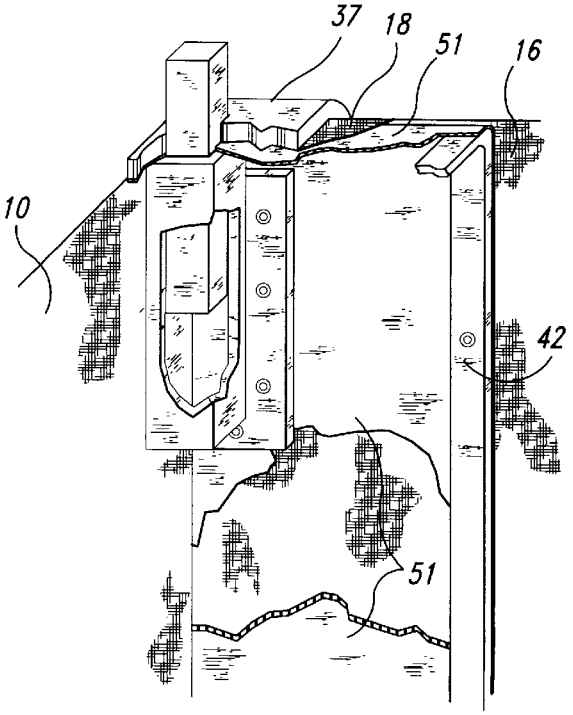

SOFT LUGGAGE HANDLE ASSEMBLY FOR WHEELED CASE

TECHNICAL FIELD

This invention relates generally to soft-sided wheeled luggage and in particular to a unique handle assembly for use in combination with soft-sided luggage supported on wheels.

BACKGROUND OF THE INVENTION

Portable luggage or cases of the type supported by wheels are known. Some of these cases are hard-sided, that is, all the walls of the case are of rigid material making the case relatively rigid so that the attachments to that case, such as the extendible handle and the wheels, are well supported by the rigidity of the walls of the case itself. Soft cases or soft-sided cases, however, do not have the rigidity of the walls of the case to support the handles and the wheel assemblies. Thus, wheel assemblies are generally built into the bottom of a case and secured to a hard wood or plastic insert in the bottom to improve the rigidity. The handle assemblies in these types of soft cases are generally extendible with a handle attached to parallel round or rectangular, solid or hollow rods that slide into hollow housings or hollow tubes. The housings can be inside of the luggage (internal handle) or the housings can be outside of the luggage (external handle) but in both instances the housings which telescopically receive the rods attached to the handle generally run the full length of the case and are attached to the more rigid base of the case in order to provide rigidity against the torque exerted when the handle is extended and being pulled.

Soft cases tend to come in three general sizes. Although exact sizes may vary from manufacturer to manufacturer, in general, a carry-on case will have a length of about twenty to twenty-three inches. A midsize case will have a length of twenty-five to twenty-seven inches. A large case will have a length of twenty-eight to thirty-two inches. As is apparent, the distance from the user's hand to the handle on the top of the case will differ depending on the size of the case. Thus, while long housings will be needed to hold the telescopic handle rods on a short carry-on case, for a large case only a short handle rod and thus a short housing will be required. It is a unique feature of this invention to recognize that long housings running from the top of the case to the bottom of the case are not necessary for larger cases and to provide a unique structural arrangement to rigidly secure these shortened housings to the top area only of a case.

In most prior art soft cases, the housings for the handle rods are extended from the top of the case to the bottom of the case even where unnecessary for large cases. Running the housings for the handle rods the full length of the case on a soft case to attach to a rigid support on the bottom of the case does provide stability to the housings but also causes difficulties. Since the housings run the full length of the case, externally mounted housings can become bent or damaged in the course of luggage handling. When the full length housings are inside of the case they take up valuable storage area that could otherwise be used for clothing. The full length housings also are obstacles around which it is difficult to pack.

Some attempts have been made to shorten the housings, particularly for larger cases where the handle needs not extend very far. U.S. Pat. No. 4,995,487 shows housings which appear to run only part way down inside of a soft case. Similarly U.S. Pat. No. 5,335,759 shows a handle assembly in which the housings only extend a slight way down into the case. Both of these prior patented cases, however, lack stability in the handle assemblies since they do not attach to the bottom support structure of the case nor are they supported elsewhere along the case except to the top wall of the case. Attempts to secure the housing assemblies only to the top wall of the case are inherently weak since heavily loaded cases when pulled along the ground will tend to twist the housing assemblies when there is a heavy pulling force applied to the handle.

Another difficulty with soft-sided cases is that the handles generally are placed inward from the opposite end-walls of the case particularly where the housings for the handle assembly are aligned with the wheel assemblies so that the housings for the handle assembly can attach to the wheel assemblies. This means, for an internal handle in particular, that the storage compartment inside the case gets divided into three somewhat equal separate areas. The housings running the full length of the case to attach to the wheel assemblies or the bottom of the case make it difficult to have a wide variety of packing options for the case. That is, ideally the inside storage area of the case would be one large unobstructed storage area to thus provide the maximum storage options for the user. Shirts, dresses, etc. would require less folds, for example.

SUMMARY OF THE INVENTION

It is an object of this invention to provide a soft-sided wheeled luggage or case in which the handle assemblies have hollow housings for telescopically receiving the rods of the handle but with the housings extending only part way down from the top of the case and being supported by at least two of the three walls forming a top corner of a case. In the preferred embodiment of a case having an external handle assembly, three walls support the housings, namely, the top wall, the rear wall, and the end wall. In this embodiment, the housing of the handle assembly is thus provided with considerable rigidity since it has three surfaces of attachment.

In the case of an internal handle assembly, the housing will be attached to an end wall and an integral stiffening plate that wraps around a corner so that the housing is again supported by a corner having two right-angle walls. This also provides considerable rigidity to the housing.

One advantage resulting is that a larger, unobstructed storage compartment is created.

Another advantage is that shorter housings for the handle assemblies are less likely to become bent or damaged.

Another advantage of the short housings is they result in a lighter weight case and cost less to manufacture.

These advantages are independent of one another but synergistically all these advantages can be obtained from this unique arrangement of the housings.

In some instances it may be desirable to not have the handle assemblies exactly at the corners of the end and rear walls but rather be spaced in from the end walls. In this instance, the housings would still be supported by at least two walls of the top corner of the case but would attach to those walls through a rigid support plate that is secured to the rear or end walls.

In the embodiments disclosed, the housings will extend down from the top wall of the case approximately two-thirds of the length of the case for a carry-on case, one-half the length of the case for a midsize case, and one-third the length of the case for a large case.

BRIEF DESCRIPTION OF THE DRAWINGS

FIG. 4 is a front elevation of a soft-sided case with the rigid housings of the handle assemblies mounted internally of the case and the front flap of the case open to expose the interior of the case.

FIG. 5 is a vertical section taken along the line 5—5 of FIG. 4 and with the case closed.

FIG. 6 is a fragmentary view of the rigid housings of the embodiment shown in FIG. 4 with parts broken away for clarity.

FIG. 7 is a front elevation with the front flap opened of a soft-sided case similar to the embodiment of FIG. 4 but showing the rigid housings located directly in the corner rather than slightly inboard as in FIG. 4.

FIG. 8 is a vertical section taken along line 8—8 of FIG. 7 and with the case closed.

FIG. 9 is an isometric fragmentary view showing the rigid housings of the embodiment of FIG. 7.

DETAILED DESCRIPTION OF THE INVENTION

Figure 1:
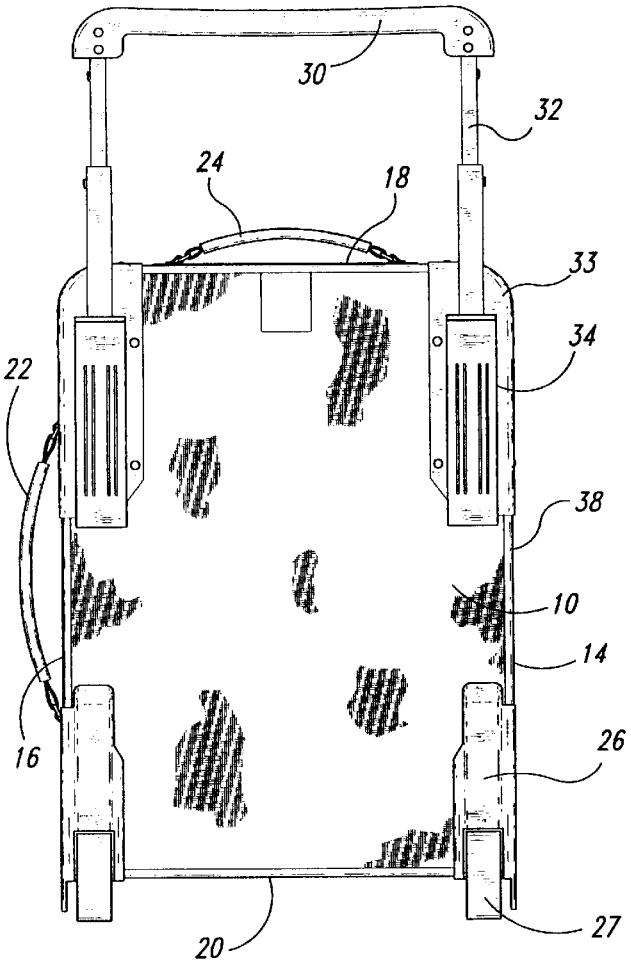
FIG. 1 is a rear elevational view of a soft-sided luggage or case having an external handle assembly embodying the principles of the invention.
Figure 2:
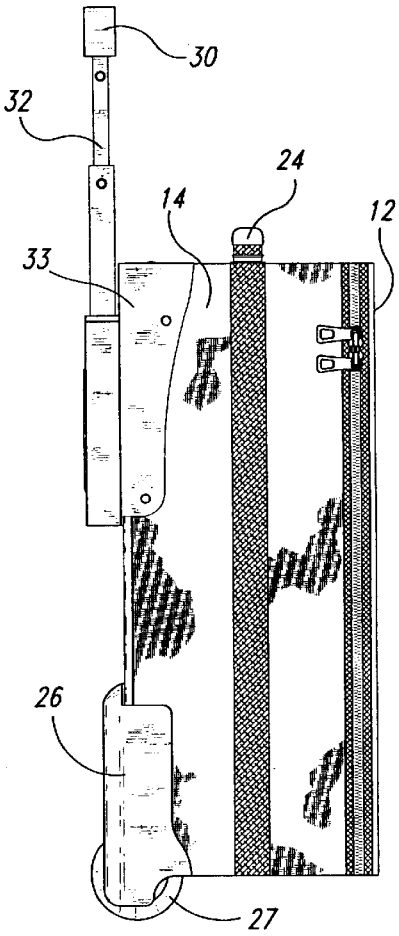
FIG. 2 is an end elevation of the case of FIG. 1.
Figure 3:
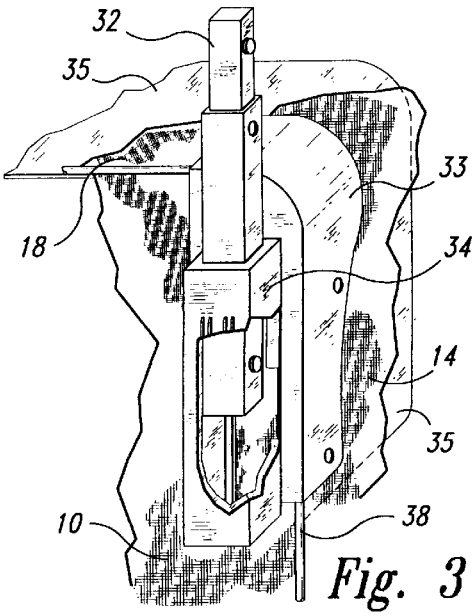
FIG. 3 is a fragmentary isometric view of rigid housings made according to the principles of the invention.

As best shown in FIGS. 1–3, one embodiment of the invention is a soft-sided, full-length suitcase or large case having a rear wall 10, a front wall or flap 12, left and right end walls 14 and 16, and top and bottom walls 18 and 20. The case has a conventional stationary end wall handle 22 and may have a stationary top wall handle 24. Mounted on the bottom of the case are wheel assemblies 26 having rotatable wheels 27. The wheel assemblies attach to a rigid bottom support plate (not shown) in a conventional manner.

It is a unique feature of this invention that the handle 30 with its parallel telescoping rods 32 fit into rigid housings 34 that are secured to the case at the top of the case. The rods may be round or rectangular and hollow or solid as is well known. Each housing in the embodiment of FIGS. 1–3 is an external housing so that the handle and rods are on the outside of the case.

The size of the case shown is a large case and the housing extends down from the top wall of the case only approximately one third of the length of the case. Each housing in this embodiment is formed with corner flanges 33 that wrap around the corner of the case and are fastened through the wall of the case to an internal corner plate 35 of plastic or other stiff material, and to the top wall 18, the end wall 14, and the rear wall 10 using rivets or other conventional fasteners.

Figure 3A:
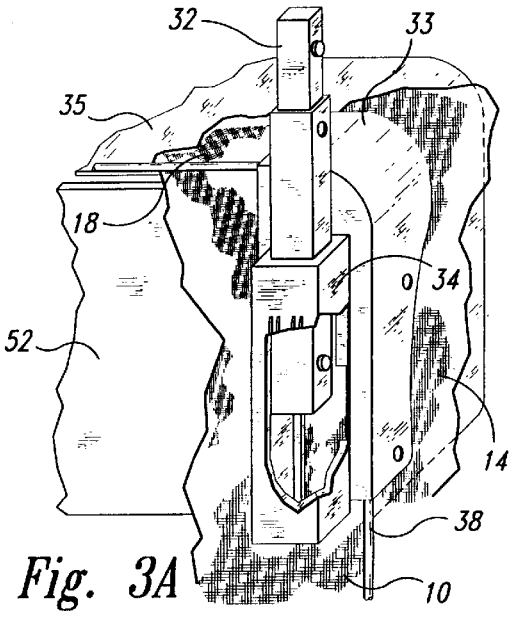
FIG. 3A is a fragmentary isometric view of a slightly modified embodiment of FIG. 1 adding a back support plate.

The housing may also abut against additional support structure inside the case. The additional support structure may be only the conventional wire welting 38 that passes completely around the periphery of the case in a corner of each wall of the case as in FIG. 3 or it may attach to a support plate 52 of stiffening material, such as, plastic, metal, hardboard, or wood, that extends across the rear wall of the case as shown in FIG. 3A.

The basic strength of the connection between the housing and the case, however, is its attachment to the corner between the top wall, the end wall, and the rear wall and it may or may not be fastened to other strengthening members that are provided in a normal soft-sided case. This three wall connection gives the housing considerable support for the tubular handle rods 32 and enables the rods to be extended and carry the weight of the case without having to extend the housings down to the wheel assemblies or the bottom of the case as is more conventional. As is readily apparent there is no extended long housing or tube running the full length of the case which could be bent or otherwise damaged during handling of the luggage as in conventional soft-sided cases.

In FIGS. 4–6, the rods 32 are also connected to the handle 30 and fit within housings 50 located internally of the case. In this embodiment the housings are secured by rivets, fasteners or other conventional devices to a rigid support plate 52 that is attached to the rear wall 10 and end walls. An external plate 36 also supports the housing and is fastened by rivets to the internal corner plate 35. While the housing 50 is not directly in the corner it is close to the corner and is well supported by the rigid support member 52, external plate 36, and internal corner plate 35. A conventional frame rail 42 of metal is also provided around the perimeter of the case. Again, as in the first embodiment the rigid housings extend down the length of the case only about one-third the length of the case, for example. This leaves the remainder of the interior of the case unobstructed for placing of garments or other materials.

In the embodiment shown in FIGS. 7–9, the rigid housings 50 are again securely fastened to the end walls 14 and 16, an external corner plate 37 and an internal support plate 51 of lightweight metal, plastic, or pressed fiberboard that extends across the top wall 18 and the full length of the end walls of the case to securely fasten the housings to at least two walls of the corner.

Figure 10:
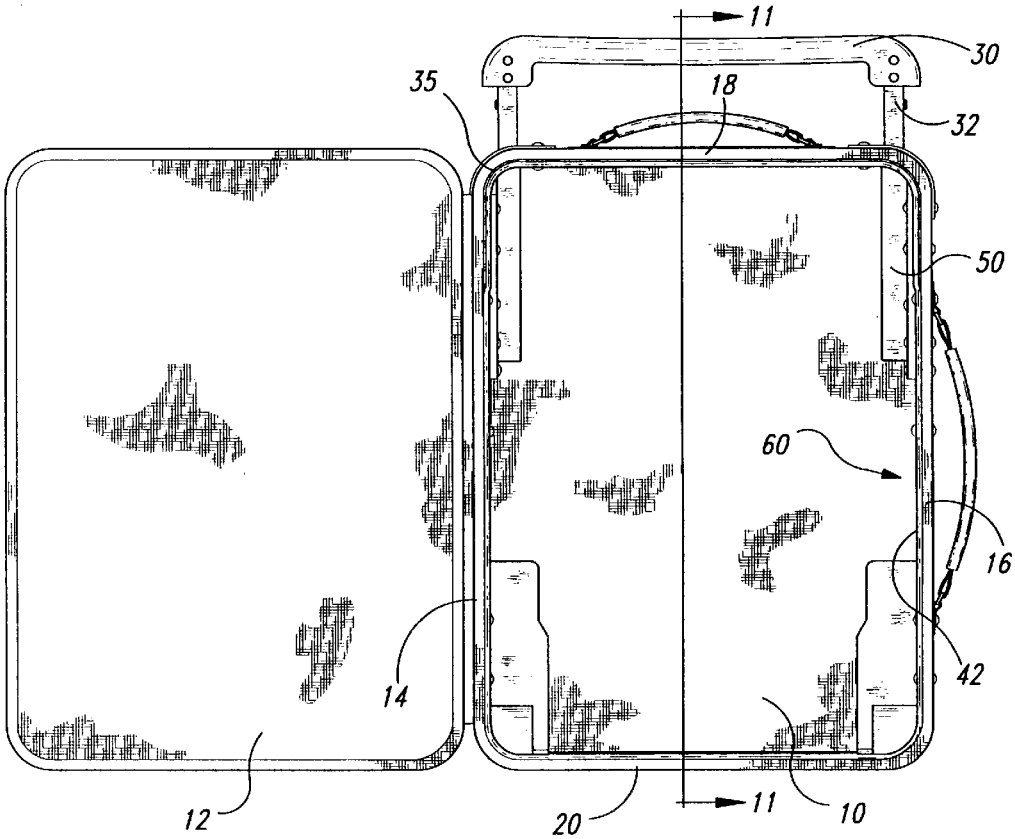
FIG. 10 is a front elevation of another embodiment of a soft-sided case with the front flap opened and showing metal bars or straps that tie the handle housings to the wheel assemblies.
Figure 11:
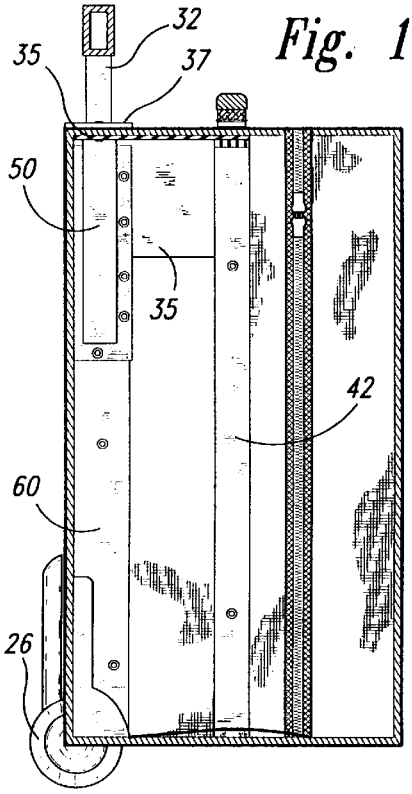
FIG. 11 is a vertical section taken along the line 11—11 of FIG. 10 and with the case closed.
Figure 12:
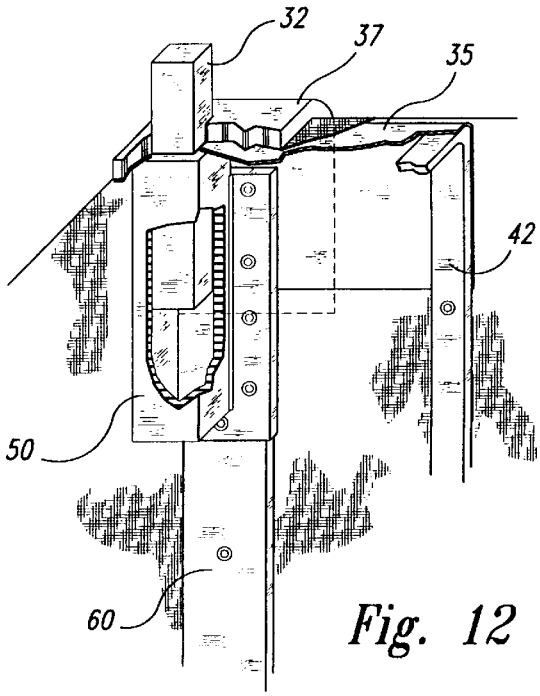
FIG. 12 is a fragmentary isometric of the handle housing of the embodiment of FIG. 10.

In the embodiment of FIGS. 10–12, the housings 50 are secured to flat metallic, wood, or plastic straps 60 that are extended to attach to the wheel assemblies 26 and/or the rigid bottom of the case and are riveted to the external corner plates 37 and the internal corner plates 35 through the end walls. The strap will be either L-shaped to conform to the corner of the rear and end wall or be a flat strap as shown. In both forms the housings will not extend the length of the case and thus will not remove storage space from inside the case, and will result in a case that has lighter weight housings and with housings that will cost less than full length housings.

In the embodiment of FIGS. 7–9 and 10–12, it can be seen that the handles and housings are out against the corners of the case, allowing the interior of the space to not be divided into compartments as is conventional with most soft-sided cases.

As shown in FIG. 7, for example, of the drawings, the housings 50 pass through the corner radius 37 of the upper rear corner of the case, that is, within the distance "x" which defines where the radius 37 intersects the top wall. Everything between this point of intersection and the adjacent end wall is considered the radius 37. This, as is readily apparent, places the housings close to the side walls 14, 16 leaving the large unobstructed storage space between the housing for storage with the need for less folds in clothing and less wrinkling to the clothing.

While the preferred embodiments of the invention have been illustrated and described it should be apparent that variations will be apparent to those skilled in the art. Accordingly, the invention is not to be limited to the embodiments as they are illustrated in the drawings.

I claim:

1. A soft-sided wheeled case having front, rear, opposite end, top, and bottom walls of a soft flexible material that are generally not self-supporting and not of themselves strong enough to support the weight of the case and the contents of the case;

wheel assemblies on the bottom of the case, and an extendible handle assembly mounted on the case externally of the case and having a central handle supported by spaced rods, the rods telescopically mounted in housings that each hold the entire rod of the handle assembly, the housings being located adjacent the end walls, the rear wall, top wall and each end wall forming opposite corners, each housing having surfaces attached to at least two of said walls forming said corners, the housings being rigid, the housings extending down along the case less than the full length of the case so as to not be connected directly to the bottom of the case, the combination of the rigid housing and said two walls forming an angle support assembly to support the extendible handle when extended against bending loads on the housing from the weight of the case and its contents without having to also connect the housings to the bottom of the case so that the housings suffer less damage during rough handling of the case because they do not extend down to the bottom of the case.

2. The case of claim 1, wherein said two walls attached to each housing are the end and rear walls.

3. The case of claim 2, wherein each said housing also being attached to the top wall at the corner of the rear, top and end walls to form a three-way support assembly.

4. The case of claim 1, wherein said two walls attached to each housing are a top and end wall.

5. The case of claim 1, wherein said housings extending down the rear wall a distance less than one half the length of the rear wall.

6. A soft-sided wheeled case having rear, front, top, bottom and opposite end walls and having an extendible handle, the dimension from the front wall to the rear wall of the case being less than the dimension between opposite end walls, wheel assemblies on the bottom of the case, the extendible handle having rods supported in housings, the housings being located inside of the case, separated from one another and close to the opposite corners formed by a rear wall and the end wall to define a large uninterrupted central storage space inside of the case between the housings to maximize the amount of uninterrupted storage space within the case so that garments may be placed in the central storage space without folds or with minimum wrinkles, the housings extending less than the full length of the case and being connected to walls of the case only and not to the bottom of the case or to the wheel assemblies.

7. The case of claim 6, wherein the end walls and the top wall of the case are joined to form opposite corners, internal corner plates connected to each end wall and the top wall, the internal corner plates each having a corner radius overlying and adjacent the respective corners between the end walls and the top wall, each said housing passing through the corner radius of the corner plate of the respective corners of the end and top wall.

8. The case of claim 6, wherein the housings being located in abutment with the rear and end walls within the corners.

9. The case of claim 6, wherein the housings extend down less than one-third the length of the case.

10. The case of claim 6, wherein the housings are attached to a support plate extending along each end wall of the case.

11. The case of claim 6, wherein the walls to which the housings are attached are a rear walls and top wall.

12. The case of claim 11, wherein the housings are located at the corners formed by the rear and end walls, thereby providing a large interior unobstructed storage space within the case.

13. The case of claim 6, the end walls and the top wall joined to form opposite corners, internal corner plates connected to each end wall and the top wall, the internal corner plates each having a corner radius overlying and adjacent the respective corners between the end walls and the top wall, each said rigid housing located within the corner radius of the corner plate of the respective corners of the end and top wall.

14. The case of claim 6, wherein said housings each being positioned closely adjacent to and directly connected to a respective end wall of the case.

15. The case of claim 6, wherein the housings extend down less than one half the length of the case viewed from the top wall of the case to the bottom wall.

16. A soft-sided wheeled case having front, rear, top, bottom and opposite end walls, the dimension from the front wall to the rear wall of the case being less than the dimension between opposite end walls, wheel assemblies connected to the bottom of the case, an extendible handle assembly attached to the case and wheel assemblies attached to the bottom wall of the case, the extendible handle assembly having elongated tubes telescopically mounted within rigid housings located inside of the case, the rigid housings attached to the case inside of the case in close proximity to the end walls of the case so as to leave a single large central storage space within the case uninterrupted by the housings for the tubes of the handle assembly to maximize the amount of uninterrupted storage space within the case so that garments may be placed in the central storage space without folds or with minimum wrinkles, the rigid housings having lower ends, the housings extending down in the case less than the full length of the case terminating along the length of the case with the housing lower ends spaced up from the bottom of the case and the housings connected to the walls of the case and not to the bottom or the wheel assemblies of the case.

17. The case of claim 16, where in the end walls and the top wall are joined to form opposite corners, an internal corner plate connected to each end wall and the top wall, the internal corner plates each having a corner radius overlying and adjacent the respective corner between the end walls and the top wall, each said rigid housing extending through the corner radius of the corner plate of the respective corner of the end and top wall.

18. The case of claim 17, wherein said internal corner plates each have a top surface facing the top wall of the case and an end surface facing the end wall of the case, the top and end surfaces of the corner plate forming said corner radius so that the corner radius of each corner plate are defined by a curve looking in from the front to the rear of the case.

19. The case of claim 16, wherein said rigid housings each being positioned closely adjacent to and directly connected to a respective end wall of the case.

20. A soft-sided wheeled case having front, rear, opposite end, top, and bottom walls of a soft flexible material that is generally not self-supporting and not of itself strong enough to support the weight of the case and the contents of the case;

wheel assemblies on the bottom of the case, and an extendible handle assembly mounted on the case externally of the case and having a central handle supported by spaced rods, the rods telescopically mounted in housings that hold the entire rod of the handle assembly, the housings being located adjacent the end walls externally of the case, the rear wall, top wall and each end wall forming a corner, each housing being attached to at least two of said walls forming said corner, the housings being rigid, the housings extending down along the case less than the full length of the case so as to not be connected directly to the bottom of the case, the combination of the rigid housing and said two walls forming an angle support assembly to support the extendible handle when extended against bending loads on the housing from the weight of the case without having to also connect the housings to the bottom of the case so that the housings suffer less damage during rough handling of the case because they do not extend down to the bottom of the case, each housing being attached to the top wall, rear wall, and end wall at the corner of the rear, top and end walls to form a three-way support assembly, said housings extending down the rear wall a distance less than one half the length of the rear wall.

21. A soft-sided wheeled case having front, rear, top, bottom and opposite end walls, the dimension from the front wall to the rear wall being less than the dimension between opposite end walls, an extendible handle assembly attached to the case and wheel assemblies attached to the bottom wall of the case, the extendible handle assembly having elongated tubes telescopically mounted within rigid housings located inside of the case, the rigid housings attached to the case inside of the case in close proximity to the end walls of the case so as to leave a single large central storage space within the case uninterrupted by the housings for the tubes of the handle assembly to maximize the amount of uninterrupted storage space within the case so that garments may be placed in the central storage space without folds or with minimum wrinkles, wherein the end walls, rear wall, and the top wall are joined to form opposite corners, internal corner plates connected to the top wall and to the end walls, the internal corner plates each having a corner radius overlying and adjacent the respective corner between the top wall and said end wall, each said housing extending through the corner radius of the corner plate of the respective corner of the end wall and top wall, the rigid housings extending down less than two thirds of the length of the case.

22. The case of claim 21, wherein said internal corner plates each have a top surface facing and engaged with the top wall of the case and an end surface facing and engaged with the end wall of the case, the top and end surfaces of the corner plate forming said corner radius so that the corner radius of each corner plate are defined by a curve looking in from the front to the rear of the case.

* * * * *